United States Patent [19]

Turk et al.

[11] 4,208,560

[45] Jun. 17, 1980

[54] INDUCTIVELY HEATED GODET

[75] Inventors: Herbert Turk, Remscheid; Günter Honigmann, Wuppertal-Elberfeld; Gerhard Martens; Lothar Schewe, both of Remscheid, all of Fed. Rep. of Germany

[73] Assignee: Barmag Barmer Maschinenfabrik AG, Remscheid-Lennep, Fed. Rep. of Germany

[21] Appl. No.: 891,015

[22] Filed: Mar. 28, 1978

Related U.S. Application Data

[63] Continuation of Ser. No. 621,537, Oct. 10, 1975, abandoned.

[30] Foreign Application Priority Data

Oct. 16, 1974 [DE] Fed. Rep. of Germany ... 7434583[U]

[51] Int. Cl.[2] ..... H05B 5/08

[52] U.S. Cl. ..... 219/10.49 R; 219/10.61 R

[58] Field of Search ..... 219/10.49, 10.61, 10.79, 219/469

[56] References Cited

U.S. PATENT DOCUMENTS

| | | | |
|---|---|---|---|
| 2,882,378 | 4/1959 | Ticeherst | 219/10.79 |
| 3,363,079 | 1/1968 | Schroyer | 219/10.79 |
| 3,412,228 | 11/1968 | Miyagi | 219/10.61 |
| 3,487,187 | 12/1969 | Martens et al. | 219/10.61 |
| 3,701,873 | 10/1972 | Bauer et al. | 219/10.61 |
| 3,772,492 | 11/1973 | Brogden et al. | 219/10.61 |
| 3,790,736 | 2/1974 | Matsumura et al. | 219/10.49 |

FOREIGN PATENT DOCUMENTS

| | | |
|---|---|---|
| 960578 | 3/1957 | Fed. Rep. of Germany . |
| 1025095 | 2/1958 | Fed. Rep. of Germany . |
| 477578 | 10/1969 | Switzerland . |

*Primary Examiner*—B. A. Reynolds
*Assistant Examiner*—Philip H. Leung
*Attorney, Agent, or Firm*—John H. Shurtleff

[57] ABSTRACT

An inductively heated godet is mounted on a supporting frame which carries a rotatable drive shaft. A stationary primary winding is mounted about a magnetic core carried by a body which is fastened to the frame. A rotatable hollow shell which concentrically surrounds the primary winding is removably secured to the rotatable drive shaft.

The magnetic core and rotatable hollow shell have in their longitudinal section essentially opposing L-shaped profiles with the flank portions thereof being concentric to the godet turning axis and the foot portion of each L-shaped profile extending substantially radially with respect to the godet turning axis toward the opposing flank portion of the other L-shaped profile such that the flank and foot portions of the shell and magnetic core form radially spaced annular gaps therebetween which are concentric to the godet turning axis. In addition, the axially directed gaps necessarily formed between the magnetic core and rotatable hollow shell are relatively large with respect to the annular gaps so that magnetic flux created by the primary winding will flow almost entirely over the smaller annular gaps. In one embodiment, the foot portion of the L-shaped profile of the shell has a recess formed therein which may be filled with an electrically conductive material which helps direct the magnetic flux and increase the heating effect in that zone of the shell. In another embodiment, the primary winding is formed of multiple electrically interconnected partial coils which are slidable on to the magnetic core.

9 Claims, 4 Drawing Figures

INDUCTIVELY HEATED GODET

This is a continuation of application Ser. No. 621,537, filed Oct. 10, 1975, abandoned.

INTRODUCTION

The present invention relates generally to an improved inductively heated godet for textile machines or the like which may be utilized to heat treat filaments, threads, yarns, ribbons, foils or similar materials running in continuous contact with the godet.

BACKGROUND OF THE INVENTION

Rotatably driven godets, which are used in such applications as stretching and texturizing operations, are well-known in the textile industry. In such operations the godet serves the purpose to convey and heat the overrunning filaments, threads, etc., to a predetermined temperature.

For example, inductively heated godets are described in German Patent DT-PS No. 1,025,095 as well as in U.S. Pat. No. 3,187,150. In addition, a variation of a godet which may be inductively heated is shown in U.S. Pat. No. 3,562,487. This latter application describing a heated godet having a double wall forming a hermetically closed annular hollow space in which a liquid is contained.

Similarly, U.S. Pat. No. 3,487,187 describes another inductively heated godet whose magnetic flux is conducted through both its cylindrical outer shell and a rotational body of laminated metal plates, the laminated plates being formed in a radially-directed, U-shaped configuration. In this device, the shanks of the U-shaped plates form with the inner wall of the surrounding godet shell a narrow cylindrical, annularly-shaped gap which is concentrical to the axis of rotation of the godet. Such U-shaped formation of the stationary magnetic core of the godet is also known from the above-mentioned U.S. Pat. No. 3,187,150 and Swiss Pat. No. 477,578.

However, such U-shaped configurations have been found to be disadvantageous in use with respect to the assembly, maintenance and repair of the godet primary magnetic winding. Namely, since the coil must be wound about the fixed rotational body, which is fastened to the carrying body of the godet in the maintenance or repair of the coil the entire godet system must be disassembled and returned to the manufacturer for rewinding of the coil. An additional disadvantage with such systems, particularly with long body godets in high-speed applications, is that the resulting heating extends over only the central portion of the cylindrical godet shell. This leads to uneven heating of the shell in operation since in such applications there exists strong air turbulence over the face side of the godet which causes severe heat loss therein and in the adjoining edge zone of the godet shell over which the filaments run. Consequently, undesirable uneven heating and irregular processing of the filaments will occur in the operation of such systems.

BRIEF DESCRIPTION OF THE INVENTION

The present invention eliminates the above-described disadvantages found with conventional godet construction by providing an improved godet design which permits efficient and inexpensive assembling, maintenance and repair of the godet primary winding and, at the same time, providing improved temperature uniformity across the godet shell over which the filaments run in operation.

The present invention comprises an inductively heated godet which is mounted on a supporting frame which carries a rotatable drive shaft. A stationary primary winding is mounted about a magnetic core which is carried by a body which is fastened to the supporting frame. A rotatable hollow shell which concentrically surrounds the primary winding is removably secured to the rotatable drive shaft. The magnetic core and rotatable hollow shell have in their longitudinal section an improved design which consists of essentially opposing L-shaped profiles with the flask portions thereof being concentric to the godet turning axis and the foot portion of each L-shaped profile extending radially with respect to the godet turning axis toward the opposing flank portion of the other L-shaped profile such that the flank and foot portions of the shell and magnetic core form radially spaced annular gaps therebetween which are concentric to the godet turning axis.

With the improved design of the present invention, the primary winding can be installed and disassembled very simply by removing the detachable godet shell from the drive shaft. In addition, since a portion of the magnetic flux energy created by the primary winding of the present invention will flow into the face plate of the godet, additional heating of the face plate and adjacent edge zones of the godet shell will occur which tend to offset the heat loss experienced therein in use.

Furthermore, with the design of the present invention, large axial magnetic forces which could lead to undesirable axial loadings on the drive shaft bearings are prevented due to the fact that axially directed gaps between the stationary primary winding parts and the rotating godet shell are relatively large in relation to the balanced radially directed annular gaps therebetween which are concentric to the godet turning axis. Therefore, the magnetic flux created between the primary winding and godet shell will flow almost entirely over the smaller radially directed annular gaps, thereby avoiding undue axial loading of the drive shaft bearings.

Improved temperature uniformity across the surface of the godet shell in use is further enhanced with the improved design of the present invention by providing a recess in the foot portion of the L-shaped profile of the godet shell. This recess may be filled with an electrically conductive material, such as according to U.S. Pat. No. 3,701,873, in order to concentrate the magnetic flux and resulting heat in this critical edge portion of the godet shell adjacent to the face plate.

The windings of the primary coil of the present invention may be constructed of a large number of suitable materials such as conventional insulated copper wires. However, these coils must be wound in a self-supporting manner so that they can be easily slid on to and off of the magnetic core of the primary coil.

Therefore, in an especially advantageous embodiment of the present invention, the coils are constructed of aluminum foil having an insulating layer of aluminum oxide on its surface. Such coils exhibit high temperature stability and efficient heat lead-off from the interior of the coil. Furthermore, such coils, can be made directly self-supporting without the necessity of cementing or otherwise casting the windings or layers of the coil. In addition, in a particular embodiment disclosed of the present invention, multiple electrically interconnected partial coils are provided as the primary coil, the partial coils being wound in alternate circumferential directions in order to provide current flow in the same direction about the individual coils.

DESCRIPTION OF THE PREFERRED EMBODIMENT

Figure 1:
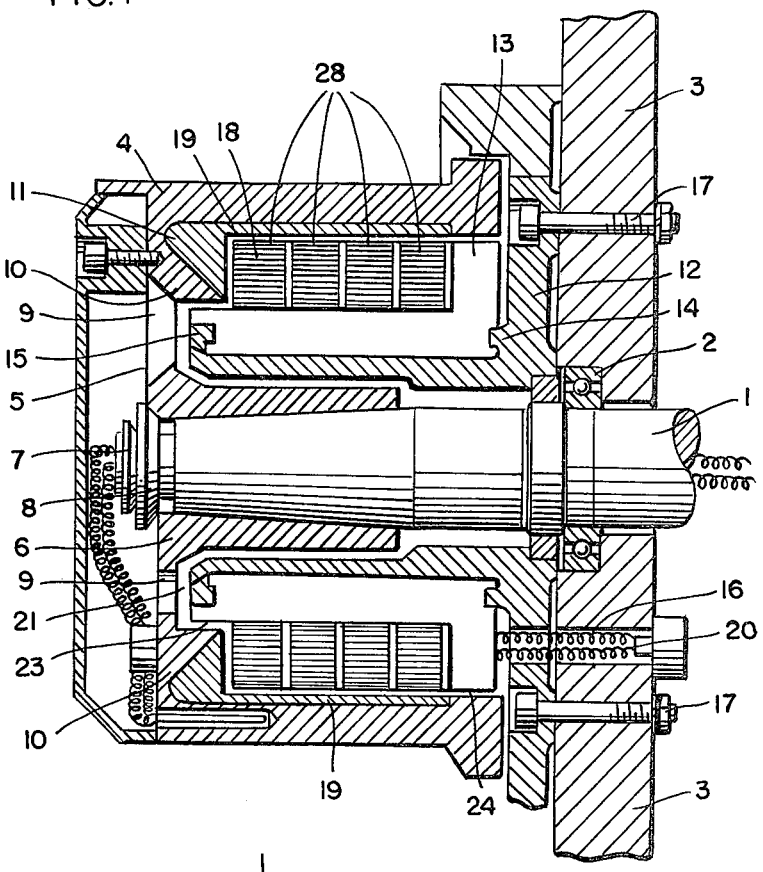
FIG. 1 is a cross-sectional view taken through the axis of rotation of a godet constructed in accordance with an embodiment of the present invention.
Figure 3:
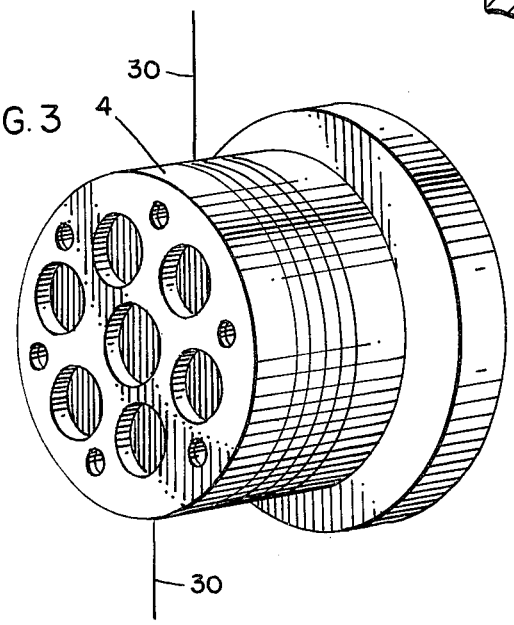
FIG. 3 is a perspective view of the godet shown in FIG. 1.

Referring to FIGS. 1 and 3 of the drawings, there is illustrated an inductively heated godet constructed in accordance with the present invention. The godet comprises a shaft 1, having an end extending beyond machine frame 3 into the interior of shell 4, which is supported by bearings 2 borne in the machine frame and is rotatably driven at its other end by a motor (not shown). The godet consists essentially of the cylindrical shell 4 over the exterior surface of which threads 30 run. Shell 4 has a face plate 5 and a hub portion 6 which are secured to the conical end of shaft 1 by means of a nut 7 and washer 8 which tap into the end of the shaft.

The godet face plate 5 is preferably not constructed as a solid piece, but with bores 9 which serve to inhibit the transfer of heat from shell 4 to hub 6 as well as shaft 1, bearings 2 and the appertaining drive gears (not shown).

Godet shell 4 has an L-shaped profile in longitudinal section. Radially extending foot portion 10 has a recess 11 formed therein which, in the preferred embodiment, is lined with an efficient electrical conducting material.

The godet comprises further a carrying body 12 which is mounted on machine frame 3 by means of bracket bolts 17. Cylindrical, laminated plate or plates 13, which may be made of a ferromagnetic material such as iron and which provide a magnetic core for the godet, are mounted on body 12 between guides 14, 15. Plates 13 likewise have an L-shaped profile, which is complementary to that of shell 4, and carry a stationary primary winding 18 which is externally supplied with electrical energy through wires 16 which extend through machine frame 3.

In the preferred embodiment, the secondary winding consists of a copper ring 19 which is secured to the inner surface of shell 4. The copper ring 19 not only extends along the inner rotational surface of shell 4 but also fills recess 11 of the shell foot portion 10.

For the assembly and inspection of primary winding 18, shell 4 is removed from about shaft 1 thereby exposing carrying body 12 and primary winding 18. The primary winding can at this point simply be axially slid or drawn off of plate 13 by disconnecting plug 20 which carries electrical supply wires 16.

With respect to the clearance between the primary and secondary windings, it is desirable that gap 21 be relatively greater in the axial direction than the annular gaps 23, 24 in the radial direction. This design feature assures that the magnetic flux field created between the windings, as is illustrated in dashed lines in FIG. 4, will tend to flow radially over annular gaps 23, 24 and any axially directed magnetic forces will be inhibited from flowing axially over gap 21.

Figure 4:
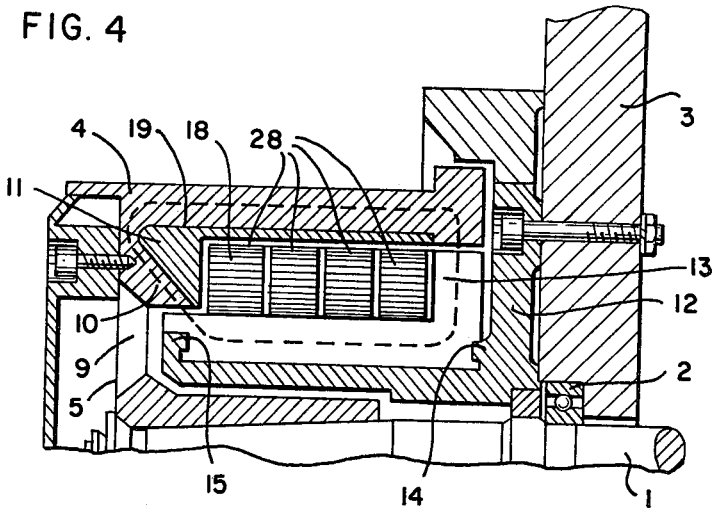
FIG. 4 is a partial cross-sectional view of a portion of the godet shown in FIG. 1 illustrated in dashed lines the magnetic flux pattern resulting with the present invention.

However, due to the L-shaped construction of shell 4 with recess 11 being filled with an efficient electrical conductor, the magnetic flux flowing between annular gaps 23, 24 will be guided into this area in the front portion of the shell, also as is illustrated in FIG. 4, thereby causing a greater heating effect in this area. This special heating of the front portion of shell 4 is desirable due to the fact that experience has shown that strong air turbulence is created across the face side of the godet in operation which causes severe heat loss therein. Hence the guidance of the magnetic flux field and its corresponding heating effect in this manner tends to compensate for this heat loss and provide a more uniform temperature across the entire axial length of the shell in operation.

Figure 2:
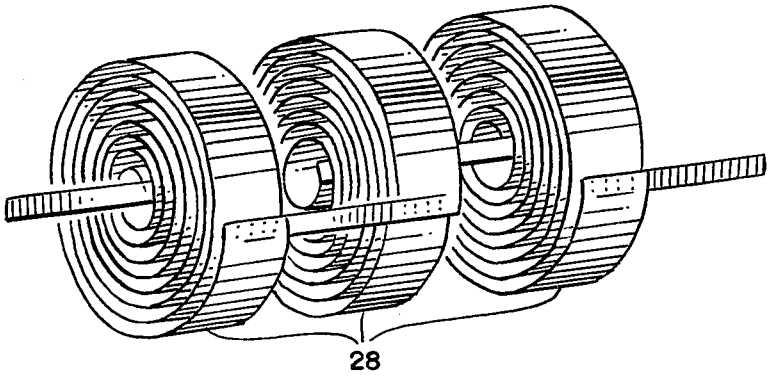
FIG. 2 is an enlarged perspective view of a portion of the apparatus shown in FIG. 1.

Primary winding 18 may be wound from any one of a number of good electrical conducting materials such as copper wire. In such case the copper wire is cast with an insulating material into a self-supporting coil which can be axially slid or drawn onto plates 13. However, it is desirable to construct the primary winding of several individual, interconnected coils as is illustrated in FIGS. 1 and 2.

Partial coils 28 are individually wound in opposite spiral directions and are electrically interconnected in series so that the current passing through the coils will uniformly flow in the same circumferential direction.

The necessity of making complex self-supporting coils by casting individual wires for the primary winding 18 or partial coils 28 may be eliminated by constructing such elements from foil. (See FIG. 2 for example) Anodically oxidized aluminum foil has been found to be particularly effective in this regard. In such cases, the width of the foil will correspond to the axial length of the primary winding 18 or of the partial coils 28. The oxide layer found on the surface of such foil provide an adequate electrical insulation without the requirement of additional intermediate insulation since such low voltages are produced between the individual layers of the coils.

For example, in a particular preferred embodiment in which the godet shell was constructed in accordance with U.S. Pat. No. 3,562,489, five individual or partial coils were utilized for the primary winding. The coils had a winding number of 300 with a foil width of 40 mm and thickness of 300 μm. The oxide layer on the surface of the foil was 5 to 6 μm thick. For 8,000 W of power the primary winding carried a voltage of about 220 V, which was well below the maximum permissable using the 5 to 6 μm oxide thickness for insulation. With this device, a stable godet temperature of over 300° C. was achieved which exhibited excellent temperature uniformity over the entire axial length of the outer, cylindrical godet shell.

While several particular embodiments of the present invention have been shown and described above, it should be understood that various obvious changes and modifications thereto may be made, and it is therefore intended in the following claims to include all such modifications and changes as may fall within the spirit and scope of this invention.

What is claimed is:

1. In an inductively heated rotatable godet of the type wherein a stationary primary winding is mounted concentrically to the godet turning axis upon a magnetic core carried by a body which is fastened to a supporting frame and a rotatable hollow shell, which concentrically surrounds said primary winding, is removably secured to a drive shaft carried by said supporting frame, the improvement comprising:

a magnetic flux conductor having a hollow, substantially rectangular longitudinal cross-section, the inner hollow contour of which surrounds in close proximity said primary winding, said conductor being formed by:

(a) said magnetic core comprising a series of L-shaped laminated plates spaced from said drive shaft and supporting frame to provide a cylindrical core member having in longitudinal section an L-shaped profile with a flask portion extending parallel to said godet turning axis and a foot portion extending radially outwardly from said turning axis along the rear side of said primary winding located closest to said supporting frame, (b) said hollow shell which is a substantially cylindrical member having in longitudinal section an L-shaped profile with a flank portion extending parallel to the godet turning axis from said supporting frame and a flanged foot portion extending radially inwardly from said flank portion along the front side of said primary winding located away from said supporting frame, said flanged foot portion forming a circular hole at its inner end into which said flank portion of the magnetic core extends, and (c) two narrow annular gaps which are located in positions concentric to said godet turning axis, one of which is radially spaced between the outer end of said foot portion of said magnetic core and the opposing flank portion of said hollow shell adjacent to said supporting frame and the other of which is radially spaced between the inner end of said foot portion of said hollow shell and the opposing flank portion of said magnetic core extending into said circular hole; and means including said stationary primary winding for generating a magnetic flux field about said conductor, said flux field as viewed in longitudinal section being substantially confined to a path extending through said L-shaped profiles of said magnetic core and said hollow shell and across the two narrow annular gaps formed by the opposing foot ends and flank portions of said shell and core, whereby the heat inductively created by said flux field is concentrated in the flank and foot portions of said hollow shell and away from said drive shaft and supporting frame.

2. The godet of claim 1 wherein axially directed gaps are further formed between said magnetic core and rotatable hollow shell, said axially directed gaps being relatively large in relation to said annular gaps.

3. The godet of claim 1 wherein said foot portion of the L-shaped profile rotatable hollow shell has a recess formed therein.

4. The godet of claim 3 wherein said recess is filled with an electrically conductive material.

5. The godet of claim 1 wherein said primary winding comprises wound aluminum foil having an electrically insulating aluminum oxide on its surface.

6. The godet of claim 1 wherein said primary winding comprises multiple electrically interconnected partial coils which are wound in alternate circumferential directions.

7. The godet of claim 6 wherein said partial coils are slidable onto said magnetic core.

8. The godet of claim 1 wherein said magnetic core comprises laminated iron plates.

9. The godet of claim 1 wherein said primary winding is axially slidable on to and off of said L-shaped magnetic core over its free end.

* * * * *

UNITED STATES PATENT AND TRADEMARK OFFICE

CERTIFICATE OF CORRECTION

PATENT NO. : 4,208,560

DATED : June 17, 1980

INVENTOR(S) : Turk et al

It is certified that error appears in the above-identified patent and that said Letters Patent are hereby corrected as shown below:

Column 5, line 15, change "flask portion" to --flank portion--.

Signed and Sealed this

*Nineteenth* Day of *August 1980*

[SEAL]

*Attest:*

SIDNEY A. DIAMOND

*Attesting Officer*

*Commissioner of Patents and Trademarks*